US005681506A

United States Patent [19]

Pragnell et al.

[11] Patent Number: 5,681,506

[45] Date of Patent: Oct. 28, 1997

[54] CORROSION INHIBITING LUBRICANT COMPOSITION

[75] Inventors: John William Anthony Pragnell, Whitchurch Hill; Andrew Jonathan Markson, Upper Basildon; Mark Anthony Edwards, Wokingham, all of United Kingdom

[73] Assignee: Castrol Limited, United Kingdom

[21] Appl. No.: 232,078

[22] PCT Filed: Oct. 29, 1993

[86] PCT No.: PCT/GB93/02218

§ 371 Date: May 9, 1994

§ 102(e) Date: May 9, 1994

[87] PCT Pub. No.: WO94/10270

PCT Pub. Date: May 11, 1994

[30] Foreign Application Priority Data

Oct. 30, 1992 [GB] United Kingdom ..... 9222824

[51] Int. Cl.[6] ..... C23F 11/14; C23F 11/12

[52] U.S. Cl. ..... 252/405; 252/407; 508/465; 508/476; 508/496; 508/486; 508/495; 508/500; 508/506; 508/508; 508/510; 508/512; 508/513; 508/262; 508/279; 508/280

[58] Field of Search ..... 252/56 R, 50, 252/407, 405; 508/465, 476, 496, 486, 495, 500, 506, 508, 510, 512, 513, 262, 279, 280

[56] References Cited

U.S. PATENT DOCUMENTS

| | | | |
|---|---|---|---|
| Re. 28,805 | 5/1976 | Braid | 252/50 |
| 2,134,736 | 11/1938 | Reuter | 252/56 D |
| 2,179,067 | 11/1939 | Smith | 252/46.6 |
| 2,261,888 | 11/1941 | Rocchini | 252/56 R |
| 2,281,676 | 5/1942 | Cook | 252/56 R |
| 2,334,158 | 11/1943 | Fuchs et al. | 44/403 |
| 2,357,211 | 8/1944 | Lincoln et al. | 252/48.6 |
| 2,417,833 | 3/1947 | Lincoln et al. | 252/33.6 |
| 2,775,560 | 12/1956 | Lurton et al. | 252/48.6 |
| 2,921,903 | 1/1960 | Beretvas | 252/37.2 |
| 3,344,068 | 9/1967 | Waight et al. | 252/47.5 |
| 3,413,227 | 11/1968 | Howard et al. | 252/51.5 R |
| 3,597,353 | 8/1971 | Randell et al. | 252/50 |
| 3,625,894 | 12/1971 | Koenig et al. | 252/33.4 |
| 3,697,427 | 10/1972 | Byford et al. | 252/49.9 |
| 3,931,022 | 1/1976 | Chesluk et al. | 252/47.5 |
| 4,101,431 | 7/1978 | Kuntschik | 252/46.7 |
| 4,153,565 | 5/1979 | Braid et al. | 252/51.5 A |
| 4,187,186 | 2/1980 | Braid | 424/44 |
| 4,440,657 | 4/1984 | Metro et al. | 252/49.9 |
| 4,483,776 | 11/1984 | Witte, Jr. et al. | 252/40 |
| 4,507,214 | 3/1985 | Aldorf | 252/18 |
| 4,826,633 | 5/1989 | Carr et al. | 252/56 |
| 5,470,504 | 11/1995 | Kiehn et al. | 252/49.6 |

FOREIGN PATENT DOCUMENTS

| | | | |
|---|---|---|---|
| 1287647 | 9/1972 | United Kingdom . | |
| 1511593 | 5/1978 | United Kingdom | C07D 235/08 |
| 1600952 | 10/1981 | United Kingdom . | |

OTHER PUBLICATIONS

"Qualified Products List of Military Specification MIL-L-23699 Lubricating Oil, Aircraft Turbine Engines, Synthetic Base Nato Code Number 0-156": QPL-23699-17, Jun. 30, 1995.

"Mitary Specification, Lubricating Oil, Aircraft Turbine Engine, Synthetic Base, Nato Code Number 0-156": MIL-L-23699E 25 Aug. 1994.

"Military Specification XAS-L-5724 Lubricating Oil, Aircraft Turbine Engine, Corrosion Inhibiting, Synthetic Base": X45-L-5724, Mar. 20, 1992.

*Primary Examiner*—Sharon Gibson
*Assistant Examiner*—Valerie Fee
*Attorney, Agent, or Firm*—Bacon & Thomas

[57] ABSTRACT

A corrosion inhibiting lubricating composition comprises:

(a) a synthetic ester base stock;

(b) at least one aromatic amine antioxidant;

(c) a neutral organic phosphate of the formula $(R^1O)_3PO$ where $R^1$ is a tolyl, phenyl, xylyl, alkyl or cycloalkyl group, the alkyl or cycloalkyl group having up to 10 carbon atoms;

(d) a saturated or unsaturated dicarboxylic acid of the general formula

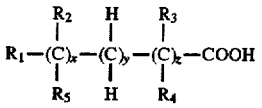

wherein x+y+z is an integer in the range from 2 to 22 inclusive and where at least one of the groups $R_1$ to $R_5$ is a carboxylic acid group; or a dicarboxylic acid of one of the three formulae

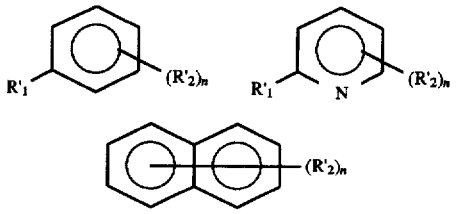

(e) a straight or branched chain saturated or unsaturated monocarboxylic acid which is optionally sulphurised or an ester of such an acid; and (f) a triazole of the formula:

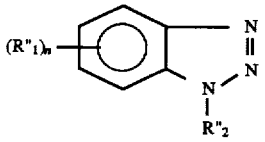

or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

12 Claims, No Drawings

CORROSION INHIBITING LUBRICANT COMPOSITION

This application is a 371 of PCT/GB93/02218 filed Oct. 28, 1993.

BACKGROUND OF THE INVENTION

1. Field of the Invention

This invention relates to a corrosion inhibiting lubricant composition.

2. Discussion of the Prior Art

Corrosion can be a serious problem in the operation and storage of aircraft gas turbine engines, particularly those which are operated in a maritime environment. The effects of corrosion in such gas turbine engines as well as other types of engine, are very costly in terms of servicing, replacement of parts, engine downtime and man/woman hours. In consequence, there is a demand for a lubricant which will substantially reduce corrosion in gas turbine engines and therefore the consequential serious effects thereof as mentioned above.

The United States Navy has recently revised their Military Specification MIL-L-23699D, the revised version of which is designated XAS-L-5724, which specifies the requirements to be met by a lubricating oil for gas turbine engines in order to achieve a higher standard in anti-corrosion properties which is seen as an important goal in view of the serious problems referred to above.

SUMMARY OF THE INVENTION

An objective of the present invention is to provide a corrosion inhibiting lubricant which meets the corrosion protection test designated as ARP 4249 (specified in XAS-L-5724) and DERD Method 18 (specified in DERD 2458).

This objective has been achieved by the compositions of the present invention.

According to the present invention there is provided a corrosion inhibiting lubricating composition comprising (a) a synthetic ester base stock;

(b) at least one aromatic amine antioxidant;

(c) a neutral organic phosphate of the formula $(R^1O)_3PO$ where $R^1$ is a tolyl, phenyl, xylyl, alkyl or cycloalkyl group, the alkyl or cycloalkyl group having up to 10 carbon atoms;

(d) a saturated or unsaturated dicarboxylic acid of the general formula

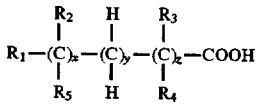

wherein x+y+z is an integer in the range-from 2 to 22 inclusive and where at least one of the groups $R_1$ to $R_5$ is a carboxylic acid group and the remaining groups $R_1$ to $R_5$ are selected from alkyl, hydroxy, carbonyl, nitro, amino, carboxyl, hydrogen, or alkyl derivatives thereof, where alkyl is a short chain of up to 5 carbon atoms; or a dicarboxylic acid of one of the three formulae

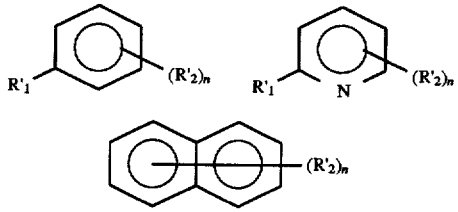

wherein $R'_1$ is —COOH alkyl, hydroxy, carbonyl nitro, amino, hydrogen, or alkyl derivatives thereof; $R'_2$ is —COOH; and n is an integer from 1 to 4 inclusive;

(e) a straight or branched chain saturated or unsaturated monocarboxylic acid which is optionally sulphurised in an amount which may be up to 35% by weight; or an ester of such an acid; and (f) a triazole of the formula:

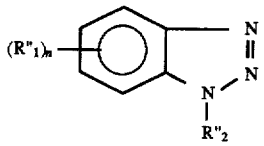

where $R''_1$ is —COOH or alkyl derivatives thereof, or short chain alkyl of up to 5 carbon atoms; n is zero or an integer between 1 and 3 inclusive; and $R''_2$ is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

In component (d) above the bicyclic structural formula is intended to indicate that the group(s) $R_2$ may be attached to either or both aromatic rings.

DETAILED DESCRIPTION OF THE PREFERRED EMBODIMENTS

The neutral liquid polyolester which forms the base stock of the lubricating composition of the present invention may be made from $C_5$ to $C_{12}$ monocarboxylic acids esterified with polyols or polyol ethers, such as neopentylglycol, dimethylolpropane, trimethylolpropane, pentaerythritol or dipentaerythritol. These are conventional synthetic ester base stocks. Preferred esters are those which are described in U.S. Pat. No. 4,826,633.

The aromatic amine antioxidant which forms component (b) of the composition may be present in a range of 0.5 to 5% by weight of the composition. Preferably up to three aromatic amine antioxidants are included, more preferably two, and the antioxidants are more preferably included in the range of 1 to 3% of the weight of the composition. The aromatic amine antioxidants which are employed in the present compositions are those conventionally included in lubricant compositions. Suitable examples are mono-octylphenylalphanaphthylamine and p,p-dioctyldiphenylamine, preferably used together.

The neutral organic phosphate which forms component (c) of the formulation may be present in an amount of 0.5 to 5% by weight of the composition. The neutral organic phosphate is also a conventional ingredient of lubricating compositions and any such neutral organic phosphate falling within the formula as previously defined may be employed. Tri-cresyl phosphate is a preferred phosphate for use in the present invention.

The three component system comprising of the specified dicarboxylic acid, the specified monocarboxylic acid and the specified triazole forms the inventive combination which gives the compositions of the present invention their particular effectiveness in corrosion inhibiting performance in the Ball Bearing Corrosion Test methods specified in the aforementioned United States Navy Specification. Additionally it is believed that the specific composition exemplified hereafter is the only one which to date has fully complied with and has been approved to both the United States Navy Specifications (MIL-L-23699D and XAS-L-5724) referred to hereinbefore. The Applicants regard each of the three above-mentioned ingredients to be essential in the achievement of the overall anti-corrosion properties of the lubricant. The dicarboxylic acid forming the first component of the anti-corrosion combination may be any dicarboxylic acid falling within the definition given hereinbefore. The dicarboxylic acid may be present in a proportion of up to 0.15% by weight of the composition. It should be noted however that it is desirable that sebacic acid or an equivalent thereof should always be present in the composition even if another dicarboxylic acid falling within the above definition is present, because sebacic acid or an equivalent of it is necessary to meet parts of the specification other than the ball corrosion test, for example for satisfactory lead corrosion resistance.

Examples of dibasic acids, other than sebacic acids, which may be used in the present invention are adipic acid, azelaic acid, dodecanedioic acid, 3-methyladipic acid, 3-nitrophthalic acid, 1,10-decanedicarboxylic acid, and fumaric acid.

The second component of the anti-corrosion combination is a straight or branch-chained, saturated or unsaturated monocarboxylic acid or ester thereof which may optionally be sulphurised in an amount up to 35% by weight. Preferably the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid.

The third component of the anti-corrosion combination is a triazole as previously defined. The triazole should be used at a concentration from 0.005% to 0.25% by weight of the total composition. The preferred triazole is benzotriazole.

A preferred example of a composition in accordance with the present invention is as follows

| | |
|---|---|
| Mono-octylphenylalphanaphthylamine | 1% |
| p,p-Dioctyldiphenylamine | 0.75% |
| Benzotriazole | 0.1% |
| Sulphurised oleic acid | 0.05% |
| Sebacic acid | 0.01% |
| Tri-cresyl phosphate | 1.5% |
| Silicon antifoam agent | 2 ppm |
| Base synthetic ester fluid | 96.59% |

Preferably the synthetic ester fluid consists of the reaction products of pentaerythritol and/or trimethylolpropane and an acid mixture comprising $C_5$ to $C_{10}$ straight and branched chain acids. Such a base stock should have a viscosity of at least 4.9 cSt at 100° C.

It should be understood that each of the three components which form the essential combination of the present invention have previously been used in lubricating compositions. However, the combination of the three components, as far as the Applicants are aware, is novel insofar as its application to corrosion inhibition as defined in the aforementioned specifications. It is believed by the Applicants that it is this combination which enables a composition encompassing the present invention to achieve the unique technical effect of meeting all the requirements, including the corrosion test requirements, of the aforementioned United States Navy Specification XAS-L-5724.

We claim:

1. A corrosion inhibiting lubricating composition comprising (a) a synthetic ester base stock having a viscosity of at least 4.9 cSt at 100° C.;

(b) at least one aromatic amine antioxidant;

(c) a neutral organic phosphate of the formula $(R^1O)_3PO$ where $R^1$ is a tolyl, phenyl, xylyl, alkyl or cycloalkyl group, the alkyl or cycloalkyl group having up to 10 carbon atoms;

and an effective corrosion inhibiting amount of the following components:

(d) a saturated or unsaturated dicarboxylic acid of the formula

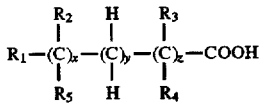

wherein x+y+z is an integer in the range of from 2, to 22 inclusive and where at least one of the groups $R_1$ to $R_5$ is a carboxylic acid group and the remaining groups $R_1$ to $R_5$ are selected from the group consisting of alkyl, hydroxy, carbonyl, nitro, amino, hydrogen, carboxyl and alkyl derivatives thereof, where alkyl is a short chain of up to 5 carbon atoms; or a dicarboxylic acid of one of the three formulae

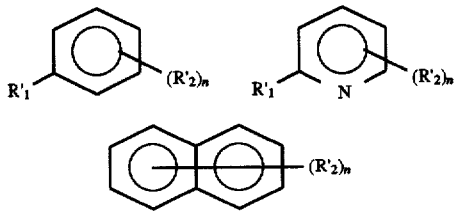

wherein $R'_1$ is —COOH, alkyl, hydroxyl, carbonyl, nitro, amino, hydrogen or alkyl derivatives thereof, $R'_2$ is —COOH; and n is an integer from 1 to 4 inclusive;

(e) a straight or branched chain saturated or unsaturated monocarboxylic acid which is optionally sulphurised; or an ester of said acid; and (f) a triazole of the formula:

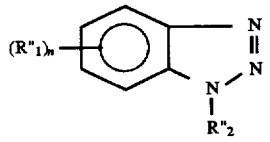

where $R''_1$ is —COOH or alkyl derivatives thereof, or short chain alkyl of up to 5 carbon atoms; n is zero or an integer between 1 and 3 inclusive; and $R'_2$ is hydrogen, morpholino, alkyl, amido, amino, hydroxy or alkyl or aryl substituted derivatives thereof; or a triazole selected from the, group consisting of 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

2. A composition as claimed in claim 1 wherein the saturated or unsaturated dicarboxylic acid is present in an amount up to 0.15% of the composition.

3. A composition as claimed in claim 1 wherein the saturated or unsaturated dicarboxylic acid is sebacic acid.

4. A composition as claimed in claim 1 wherein the monocarboxylic acid is present in an amount from 0.001% to 0.35% by weight of the composition.

5. A composition as claimed in claim 1 wherein the monocarboxylic acid is sulphurised oleic acid.

6. A composition as claimed in claim 1 wherein the triazole is present in amount from 0.005% to 0.25% by weight of the composition.

7. A composition as claimed in claim 1 wherein the triazole is benzotriazole.

8. A composition as claimed in claim 1 wherein the antioxidant comprises two aromatic amines.

9. A composition as claimed in claim 1 wherein the antioxidant amine or amines comprise from 1 to 3% by weight of the composition.

10. A composition as claimed in claim 1 wherein the neutral organic phosphate comprises from 0.5 to 5% by weight of the composition.

11. A composition as claimed in claim 1 wherein the synthetic ester base stock comprises one or more esters derived from one or more monocarboxylic acids having from 5 to 12 carbon atoms and one or more polyols or polyol esters.

12. A method of imparting corrosion inhibiting properties to a lubricant composition comprising incorporating into said lubricant composition art effective corrosion inhibiting amount of the following components:

(i) a saturated or unsaturated dicarboxylic acid of the general formula

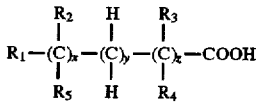

wherein x+y+z is an integer in the range of from 2 to 22 inclusive and where at least one of the groups $R_1$ to $R_5$ is a carboxylic acid group and the remaining groups $R_1$ to $R_5$ are selected from the group consisting of alkyl, hydroxy, carbonyl, vitro, amino, hydrogen, carboxyl and alkyl derivatives thereof, where alkyl is a short chain of up to 5 carbon atoms; or a dicarboxylic acid of one of the three formulae

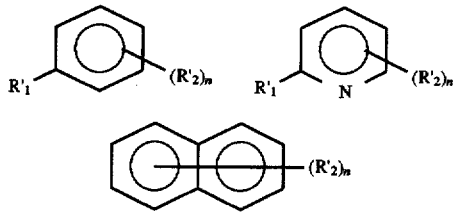

wherein $R'_1$ is —COOH, alkyl, hydroxyl, carbonyl, vitro, amino, hydrogen or alkyl derivatives thereof, $R'_2$ is —COOH; and n is an integer from 1 to 4 inclusive;

(ii) a straight or branched chain saturated or unsaturated monocarboxylic acid which is optionally sulphurised; or an ester of said acid; and (iii) a triazole of the formula:

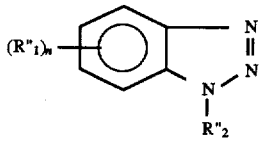

where $R'_1$ is —COOH or alkyl derivatives thereof, or short chain alkyl of up to 5 carbon atoms; n is zero or an integer between 1 and 3 inclusive; and $R''_2$ is hydrogen, morpholino, alkyl, amido, amino, hydroxy or alkyl or aryl substituted derivatives thereof; or a triazole selected from the group consisting of 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

* * * * *